US007594702B2

(12) United States Patent
Lowery

(10) Patent No.: US 7,594,702 B2
(45) Date of Patent: Sep. 29, 2009

(54) HIGHWALL MINING SYSTEM FOR TRANSPORTING MINED MATERIAL FROM A MINED HOLE TO AN OUTSIDE AREA

(76) Inventor: Sterling Wayne Lowery, 4860 Sadler Rd., Glen Allen, VA (US) 23060

( * ) Notice: Subject to any disclaimer, the term of this patent is extended or adjusted under 35 U.S.C. 154(b) by 0 days.

(21) Appl. No.: 10/867,139

(22) Filed: Jun. 14, 2004

(65) Prior Publication Data

US 2004/0251732 A1 Dec. 16, 2004

Related U.S. Application Data

(60) Provisional application No. 60/477,804, filed on Jun. 11, 2003.

(51) Int. Cl.
*E21C 35/20* (2006.01)

(52) U.S. Cl. ..... 299/64

(58) Field of Classification Search ..... 299/64, 299/65, 67, 18; 198/300, 305, 586, 861.1
See application file for complete search history.

(56) References Cited

U.S. PATENT DOCUMENTS

| | | | | | |
|---|---|---|---|---|---|
| 729,566 | A | * | 6/1903 | Foglesong | 299/18 |
| 1,723,383 | A | * | 8/1929 | Smith | 414/787 |
| 2,143,522 | A | * | 1/1939 | McCarthy | 299/18 |
| 2,195,544 | A | * | 4/1940 | Stahl et al. | 414/373 |
| 2,355,178 | A | * | 8/1944 | Peale et. al. | 299/66 |
| 2,826,402 | A | | 3/1958 | Alspaugh | |
| 3,039,596 | A | * | 6/1962 | Poundstone | 198/812 |
| 3,497,055 | A | | 2/1970 | Oslakovic | |
| 3,574,405 | A | * | 4/1971 | Shimada et al. | 299/64 |
| 4,014,574 | A | * | 3/1977 | Todd | 299/1.4 |
| 4,898,496 | A | * | 2/1990 | Pfeiffer et al. | 405/141 |
| 5,112,111 | A | | 5/1992 | Addington | |
| 5,232,269 | A | | 8/1993 | Addington | |
| 5,261,729 | A | | 11/1993 | Addington | |
| 5,364,171 | A | | 11/1994 | Addington | |
| 5,513,903 | A | * | 5/1996 | Mraz | 299/18 |
| 5,582,465 | A | | 12/1996 | Mraz | |
| 5,609,397 | A | | 3/1997 | Marshall | |
| 5,692,807 | A | | 12/1997 | Zimmerman | |
| 6,109,699 | A | | 8/2000 | Mraz | |
| 6,220,670 | B1 | | 4/2001 | Mraz | |
| 6,644,753 | B2 | | 11/2003 | Mraz | |

* cited by examiner

*Primary Examiner*—Sunil Singh

(57) ABSTRACT

A mining system for advancing and retrieving a material transfer unit, such as a car, sled, beam or other vehicle commonly used in the mining industry to transport ores or minerals from a mine, into and out of a mine. A single material transfer unit is connected to a winch system which is actuated to advance the unit into the mine. A winch system is actuated to retrieve the unit from the mine with its load of mined product. The load is then removed from the transfer unit outside the mine so that it may be advanced back into the mine to retrieve another load.

8 Claims, 20 Drawing Sheets

HIGHWALL MINING SYSTEM FOR TRANSPORTING MINED MATERIAL FROM A MINED HOLE TO AN OUTSIDE AREA

CROSS REFERENCE TO RELATED APPLICATIONS

The present application claims priority from U.S. Provisional Application Ser. No. 60/477,804 filed Jun. 11, 2003. The present application is related to U.S. patent application Ser. No. 10/862,255 entitled "Platform And Driver For Coal Mining System," now abandoned Ser. No. 10/862,205 entitled "Advancer for Coal Mining System" now abandoned and Ser. No. 10/862,254 filed Jun. 7, 2004, entitled "Shield System For Coal Mining" now U.S. Pat. No. 7,207,632, all incorporated by reference herein in their entirety.

FIELD OF THE INVENTION

The invention is generally related to an improved system for coal mining. More particularly, the invention is directed to a winch for high wall mining.

DESCRIPTION OF RELATED ART

Highwall mining is generally a method of mining whereby a remote controlled continuous miner is sent into a face of coal, or other ore, from an outside bench to mine or cut such ore out from under the overburden above. The continuous miner will generally cut out the ore in widths ranging from six to twelve feet in width and up to fourteen feet in height, depending on the size of miner used. As the miner is remotely controlled from outside into the ore, units for transferring the mined ore, called "cars" or "beams," are sequentially sent into the mine, forming a continuous train and transferring the ore from car to car to the outside bench. Various methods are incorporated into the units for transferring the ore, including conveyors, chains and screws. Likewise various methods are used to power the transferring units, including electrical power, hydraulics and/or mechanical drive shafts. The cars or beams are generally either coupled or pinned together, allowing some degree of deflection between them to improve negotiation of the rough surface in the mine.

On the outside of the mine, a launch platform is positioned to receive the transferred material as it is discharged from the rear car or beam and direct it either to a truck or stockpile via belt conveyors and/or chain conveyors. The launch platform also acts as a staging area to insert and retrieve the cars as needed and also act as a drive station to either hydraulically, electrically or mechanically drive or push the cars into the mine.

Additional roof problems are created by not controlling the direction of the miner precisely as it is driven into the mine. If the miner is not steered properly, the pillar or rib in between two mines can be cut. When the system cuts through the pillar exposing the width of two cuts, which can be as much as twelve feet in width each, twenty feet or more of unsupported roof is exposed. This greatly increases the potential for major roof falls, thus increasing the potential for entrapment.

Systems commonly used today require significant force to push the transfer units and the miner into particularly deep mines. In deep mines, this force often causes the cars to buckle up and down throughout the hole binding. Because of this, the depth to which they can be pushed is limited.

Current disclosed methods of remote mining in ore deposits such as coal generally employ a mining machine that excavates mine openings to some distance from the seam exposure on the surface and a system for conveying the mined ore to the surface. In most of the present systems, the system for conveying consists of multiple conveyors which are advanced into the mine openings from the surface. U.S. Pat. Nos. 6,644,753 and 6,220,670 issued to Mraz disclose a method and apparatus for mining of aggregate material from a seam which includes a mining apparatus and a self-propelled conveyor capable of advancing or retreating in the seam on its own power and an advancing and steering arrangement for the mining apparatus. U.S. Pat. No. 5,582,465, also issued to Mraz, discloses a system for removing a self-propelled vehicle from a downwardly sloping mine. U.S. Pat. No. 6,109,699 discloses a system for using a tow rope to advance and retrieve control lines for a miner independent of the movement of the miner.

U.S. Pat. Nos. 5,112,111, 5,232,269, 5,261,729 and 5,364,171 to Addington et al. disclose an assembly of conveyors and a mining machine advanced into the seam without interrupting the flow of aggregate material by separate means designed to pull at the forward end and push at the rearward end. Similarly, U.S. Pat. No. 5,609,397 to Marshall et al. discloses an assembly of conveyors interconnected with a mining machine and a driving device located outside the seam and consisting of rack and pinion or, alternately, reciprocating cylinders, linear tracks, linear or rotary drives, chains, cables or other mechanical devices. U.S. Pat. No. 5,692,807 to Zimmerman discloses a guidance assembly for extending and retracting an assembly of conveyors into and out of the seam. U.S. Pat. No. 3,497,055 to Oslakovic et al. discloses a multi-unit train of conveyors having a self-propelled unit at each end coupled to intermediate units, each end unit being capable of towing the intermediate units. U.S. Pat. No. 2,826,402 to Alspaugh et al. discloses a train of wheeled conveyor sections pulled into the mine opening and pushed out of it by a self-propelled mining machine. Buckling of the train is avoided by the grooves made by the mining machine in the floor, said grooves spaced the same distance as the treads of the wheels carrying the conveyor sections.

At present, as the interconnected assembly of the mining machine and a plurality of material handling units is advanced some distance into the seam from a launch vehicle located on the outside, the axial force within the assembly becomes excessive with respect to its length and the assembly becomes less rigid. As a consequence, it becomes difficult to steer the mining machine located at the front of the assembly and the conveying assembly itself can become unstable, which limits the penetration depth of mining.

The interconnected assembly of miner and cars/beams underground are exposed to roof falls and possible entrapment and great loss if not recovered. Also, on the bench, the cars/beams have to be stacked and stored and delivered to and from the platform as the system penetrates into or retreats out of the hole. Having only one material handling device verses multiple cars/beams would substantially decrease the equipment at risk underground in event of roof fall and eliminate bench storage space required to store cars/beams.

Having multiple material transfer units underground, connected as a train of cars or beams, that are constructed of mechanical drive shafts, chains, sprockets, belts, belt rollers, belt drives and/or electrical drives increases the likelihood of component failure and decreases the availability of the system. Even in the event roof conditions require a system of shields to protect transport of the mined material, a single material transfer unit can be winched in and out of a mine within the shields and still reduce the likelihood of component failure and increase the availability of the system.

Accordingly, it is an object of the present invention to provide an improved system for advancing a material transfer unit for mined material into and out of mines.

It is another object of the present invention to provide an improved system for advancing a shielded or unshielded material transfer unit into and out of mines.

It is another object of the present invention to provide a system for removing a miner and/or a material transfer unit from within a mine in the event either becomes entrapped.

It is another object of the present invention to provide an improved mining system which reduces or eliminates down time caused by falling rocks or cave-ins.

It is a further object of the present invention to provide an improved mining system which provides increased control of the material transfer unit at greater mine depths.

It is yet a further object of the present invention to provide an improved mining system which provides greater directional control of the miner and transfer units.

Finally, it is an object of the present invention to accomplish the foregoing objectives in a safe and cost effective manner.

SUMMARY OF THE INVENTION

An improved mining system for advancing mining equipment, such as a car, a buggy, a beam or a sled, into and out of a mine, includes a winch system and at least one winch rope connected to the mining equipment which is actuated by the winch system. The mining equipment may travel on wheels, rails or a flat bottom surface and may include sidewall rollers on the external surface of the sidewall of the equipment to prevent the sidewalls from contacting the wall of the mine. The mining equipment may also include a device for preventing the forward and rearward ends of the equipment from extending into the floor of the mine while the equipment is being advanced into and out of the mine, such as an upturned nose element. The winch system may be a single winch or multiple winches and may be located on a miner located within the mine or external to the mine on a platform. If a platform is used, it preferably includes a system for unloading the mining equipment, such as a scraping blade, once the mining equipment is removed from the mine. An actuation system causes the winch means to advance the mining equipment into the mine. When the mining equipment is to be removed from the mine, an actuation system causes a winch to pull the mining equipment out of the mine. Multiple actuation systems are used to actuate multiple winches if multiple winches are used. In the preferred system, one winch is connected to the mining equipment by means of a winch rope which is actuated to advance the mining equipment into the mine while a second winch is connected by means of a second winch rope which is actuated to retrieve the mining equipment from the mine. Preferably, the mining equipment includes a guide for the winch rope or ropes. If desired, or as needed, shields may be placed within the mine and the mining equipment may be advanced into and out of the mine within the shields.

ELEMENT LIST

Figure 1:
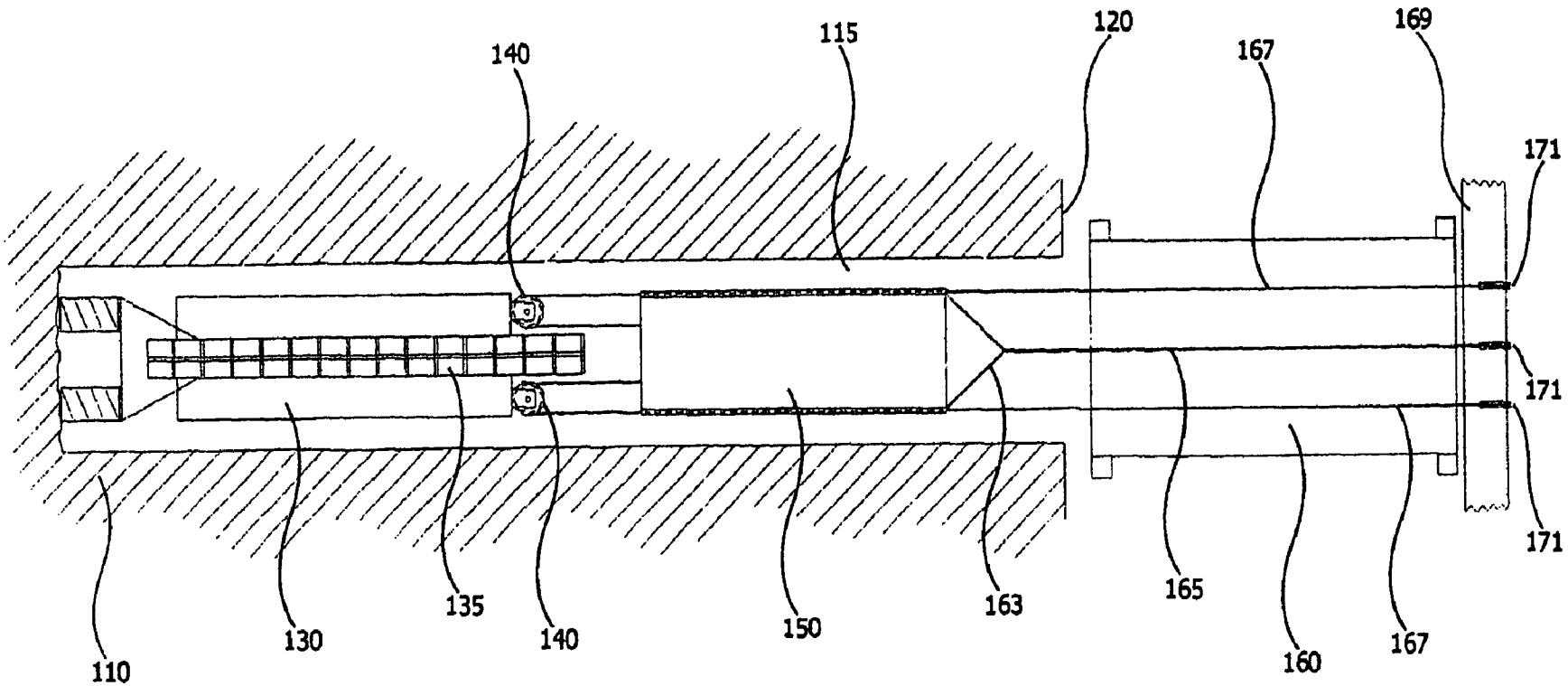
FIG. 1 is plan view of preferred embodiment of the present invention.

| | |
|---|---|
| 110 | Coal or ore |
| 115 | Mined hole |
| 120 | Highwall |
| 130 | Auger style continuous miner |
| 133 | Drum style continuous miner |
| 135 | Miner discharge conveyor |
| 137 | Pull back winch |
| 140 | Return sheaves |
| 145 | Shield |
| 147 | Guide rollers/Fairleads |
| 149 | Pull pin |
| 150 | Sled |
| 151 | Stiffener plates |
| 153 | Sled side frames |
| 154 | Sled wheels |
| 155 | Sled floor plate |
| 157 | Sled nose |
| 160 | Platform |
| 161 | Miner/water/control cable rollers |
| 163 | Pull out sling |
| 164 | Side rollers |
| 165 | Main pull out winch rope |
| 167 | Haul back rope |
| 169 | Side discharge cross conveyor |
| 171 | Lower guide sheaves |
| 180 | Surge feeder |
| 185 | Surge feeder conveyor |
| 200 | Driver-puller-scraper |
| 203 | Ejection blade |
| 205 | Ejection blade lift cylinder |
| 211 | Driver-puller-scrapper chain |
| 213 | Hold down beam |
| 215 | Hold down rollers |
| 217 | Driver-puller-scrapper sprocket |
| 225 | Belly conveyor |
| 230 | Control cab |
| 232 | Pull out winch |
| 233 | Haul back winch |
| 234 | Corner post |
| 237 | Upper Guide sheaves |

-continued

| | |
|---|---|
| 245 | Electrical/mechanical room |
| 247 | Fleet angle compensators |
| 250 | Floor opening |
| 255 | Rope guides |
| 256 | Guide rollers |
| 257 | Cable treys |
| 457 | Ejector arm |
| 459 | Driven ejector blade |

DETAILED DESCRIPTION OF THE PREFERRED EMBODIMENT

Referring now to the drawings, FIGS. 1-8 show several embodiments of the present invention. As shown, the invention can be used with different types of winch rigging arrangements to pull a non-motorized or motorized, sled or buggy, transferring mined material into and out of a mine. As used herein, the term "sled" is meant to include any type of vehicle used in the mining industry to transport ores or minerals from within a mine to the outside, including but not limited to sleds, cars, buggies, beams, etc. The present invention is suitable for use with any type of continuous miner used in the mining industry.

Figure 1A:
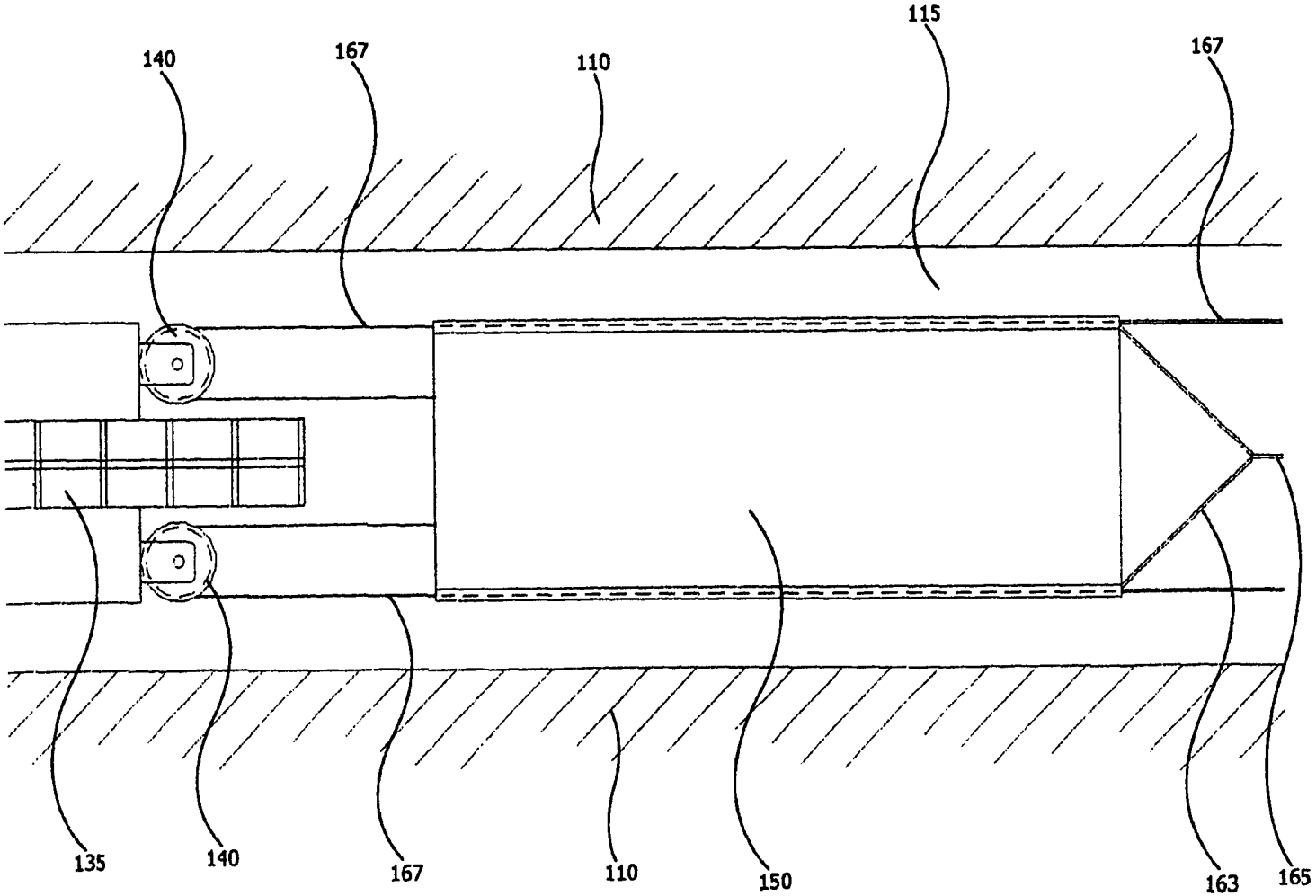
FIG. 1*a* is an exploded view of FIG. 1.

FIGS. 1 and 1*a* generally show a sled being pulled into and out of a mined hole 115 by three winch ropes. More particularly, the plan view in FIG. 1 shows an auger style miner 130 in a mined hole 115 cutting into the coal or ore 110. The sled 150 is being winched back to the miner 130 by haul back ropes 167 which run through return sheaves 140 attached to the rear of miner 130. When winching is complete, the sled 150 receives mined material fed from rear of the miner 130 over the miner discharge conveyor 135. The winches 232 and 233 are located on the deck of a platform 160 and pull the winch ropes 165 through the lower guide sheaves 171. The main pull out rope 165 runs down through the lower guide sheaves 171 to the pull out sling 163 which is attached to either side of the sled 150. The platform 160 sits outside of the hole 115 being mined into the highwall 120 on a bench. At the rear of the platform 160 is a side-discharge cross feed conveyor 169 which will either feed to trucks, a storage pile or a stacker conveyor. One winch 232 is used to pull out the main pull out winch rope 165 and one winch 233 with a divider in the center is used to pull out the haul back ropes 167. Alternatively, two winches 233 can be used to winch the haul back ropes 167.

Figure 2:
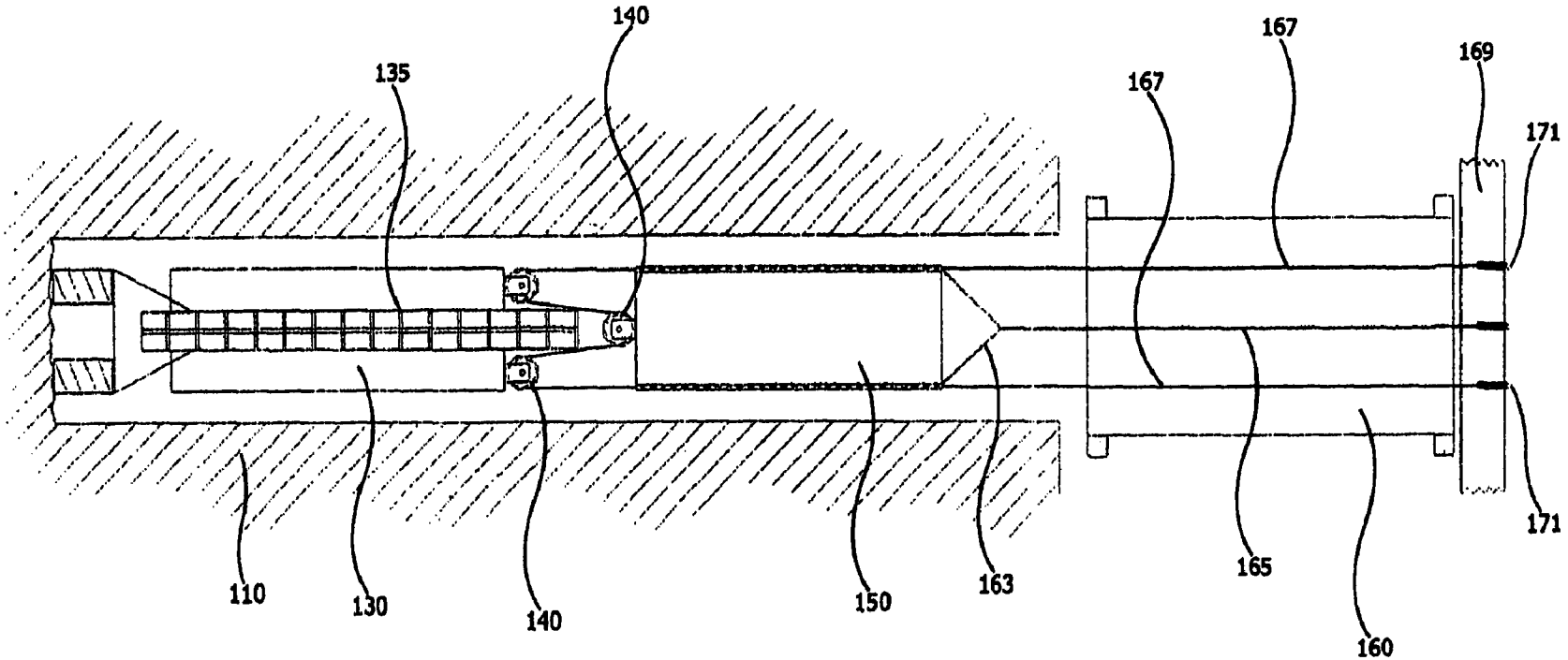
FIG. 2 is a plan view showing an alternate embodiment of the present invention.
Figure 2A:
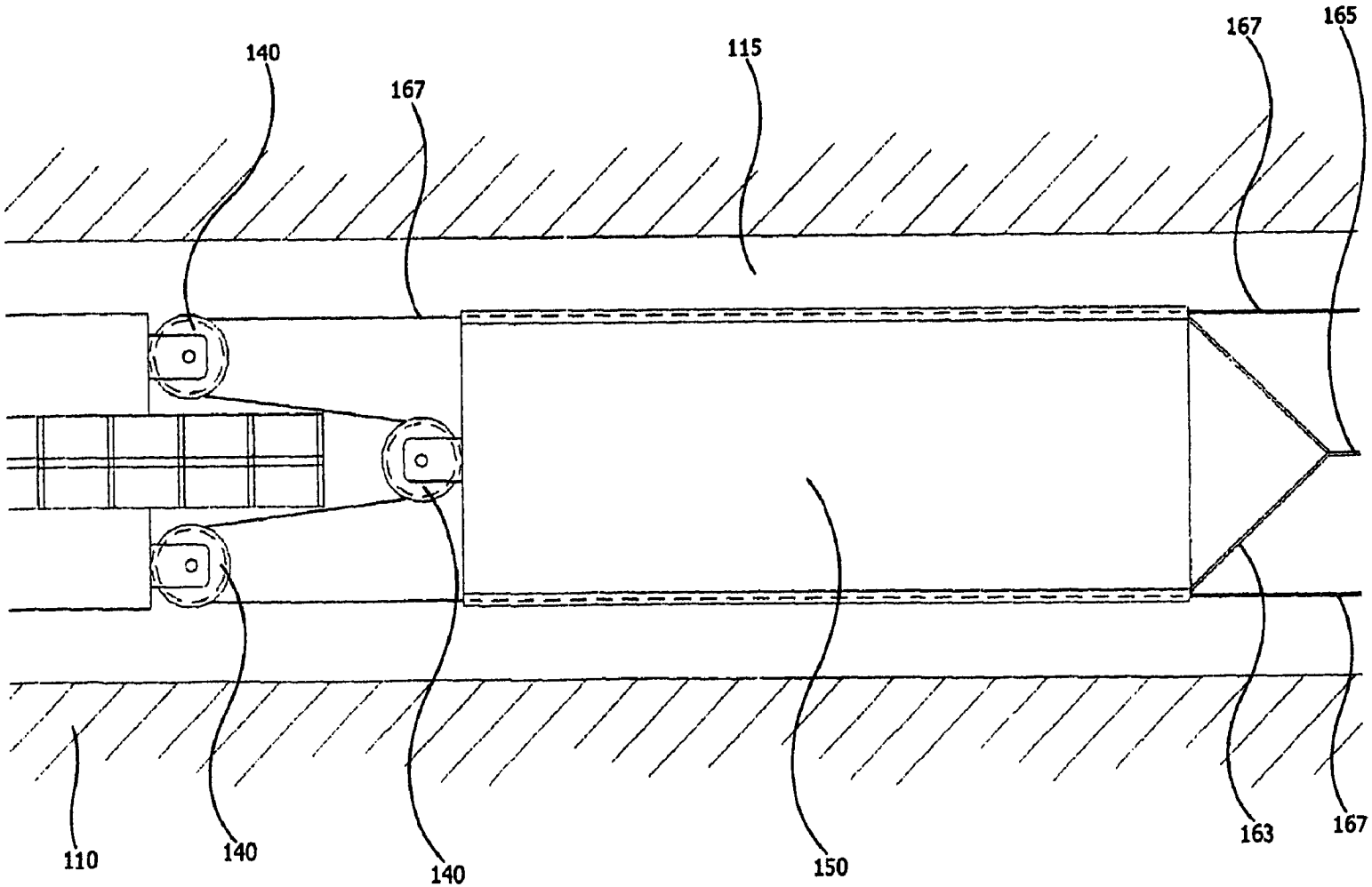
FIG. 2*a* is an exploded view of FIG. 2.

FIG. 2 shows a plan view of another winch line arrangement showing the haul back rope 167 running continuously down through the lower guide sheaves 171 and through the side of the sled 150. The rope 167 then winds around three return sheaves 140 located on the rear of the miner 130 and the rear of the sled 150. Upon exiting the third return sheave 140, the rope 167 extends through the opposite side of the sled 150 and back to the platform 160. The haul back rope 167 is either attached to a tie off point or run through the lower return sheave 171 up to the winch. The haul back rope 167 can be either powered through two winch drums or one split by divider plate. This type of arrangement provides a distinct mechanical advantage by providing almost twice the line pull force of the size rope used. This advantage can be used as safety factor if pull out force is needed due to rock fall. If the sled 150 is pulled back to the miner 130, then sufficient force is generated to pull out the miner 130 as well.

Figure 3:
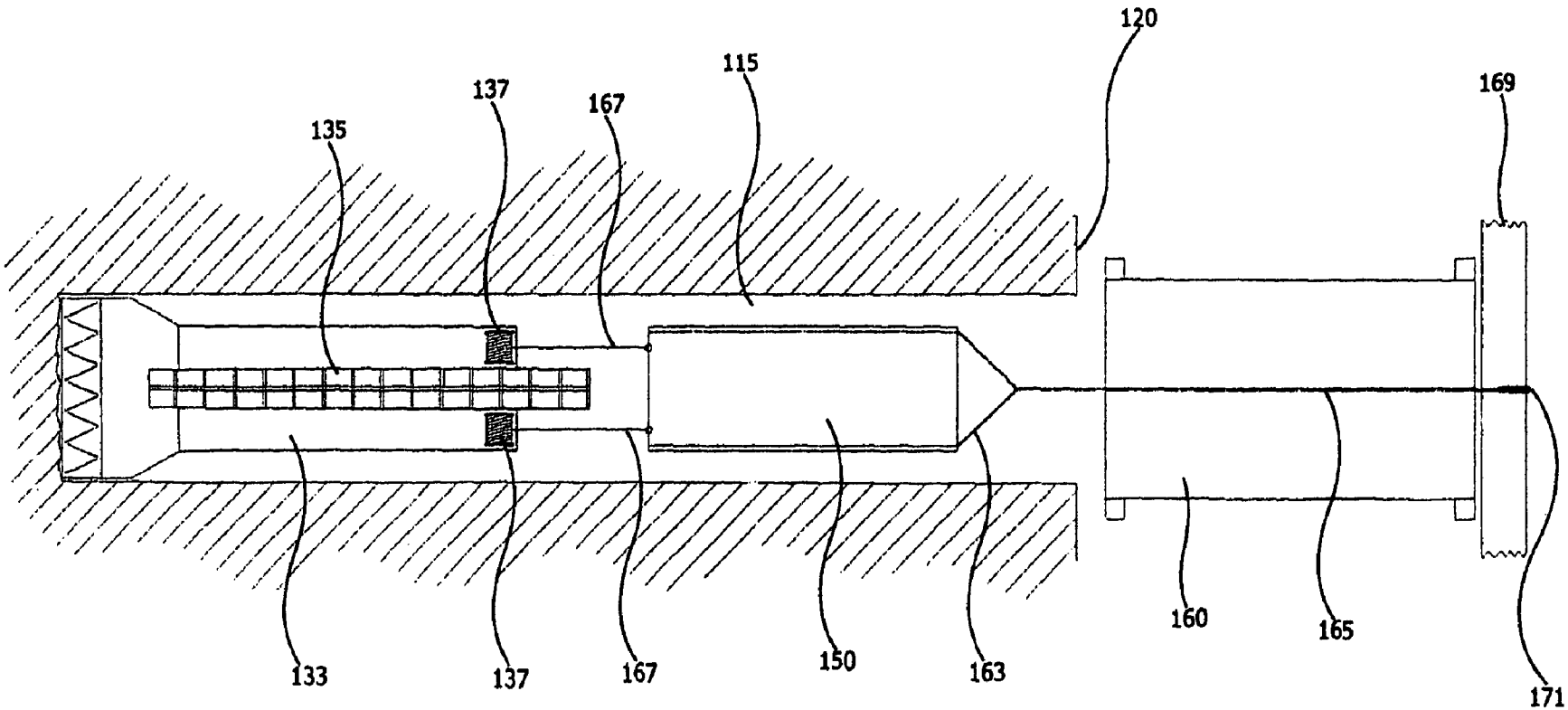
FIG. 3 is a plan view showing an alternate embodiment of the present invention.
Figure 3A:
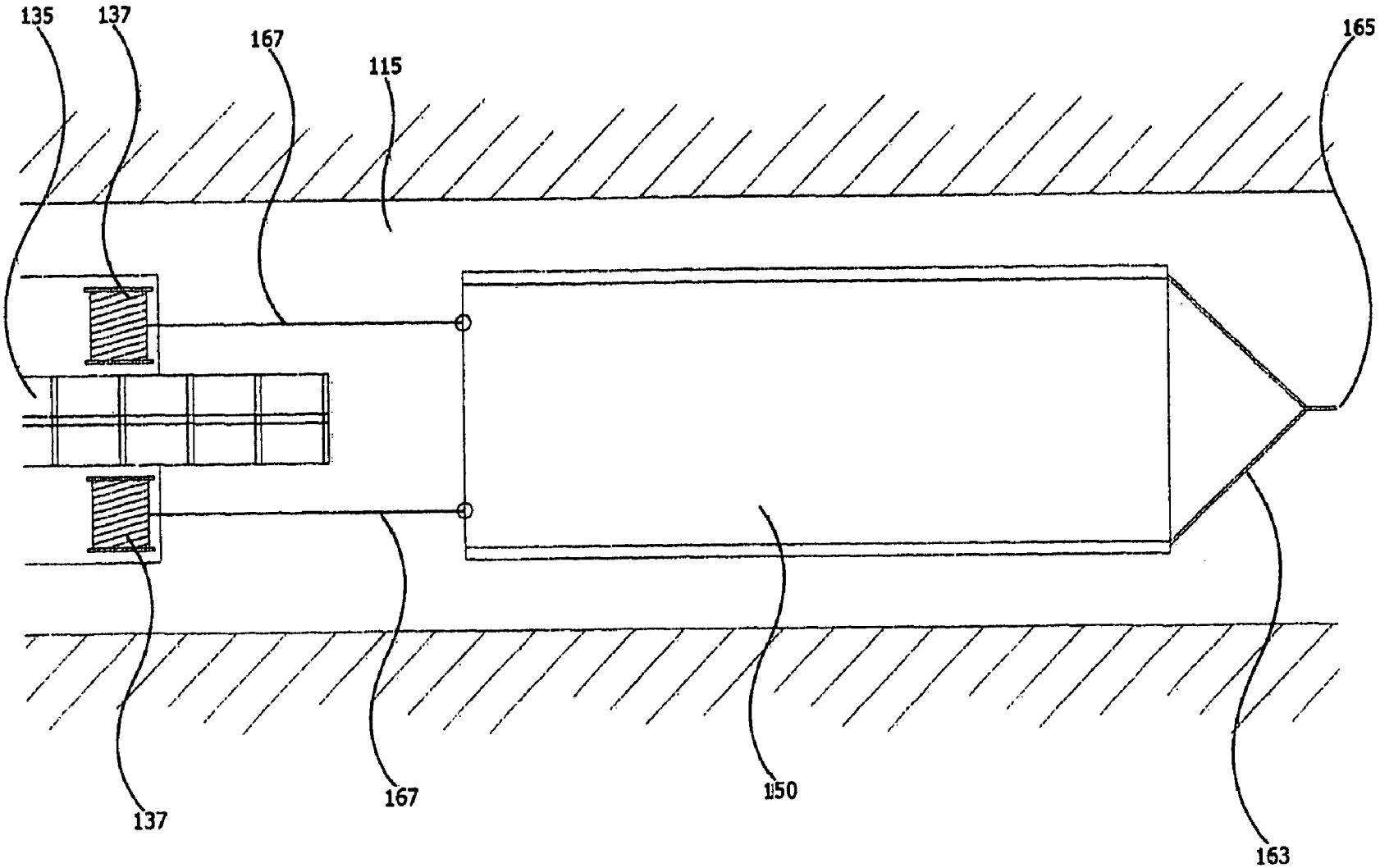
FIG. 3*a* is an exploded view of FIG. 3.

FIGS. 3 and 3*a* show an alternate winch arrangement in which two pull back winches 137 attached to the rear of a drum style continuous miner 133 pull the sled 150 back to the drum style continuous miner 133. The main pull out winch rope 165 is still pulled from the outside platform 160.

Figure 4:
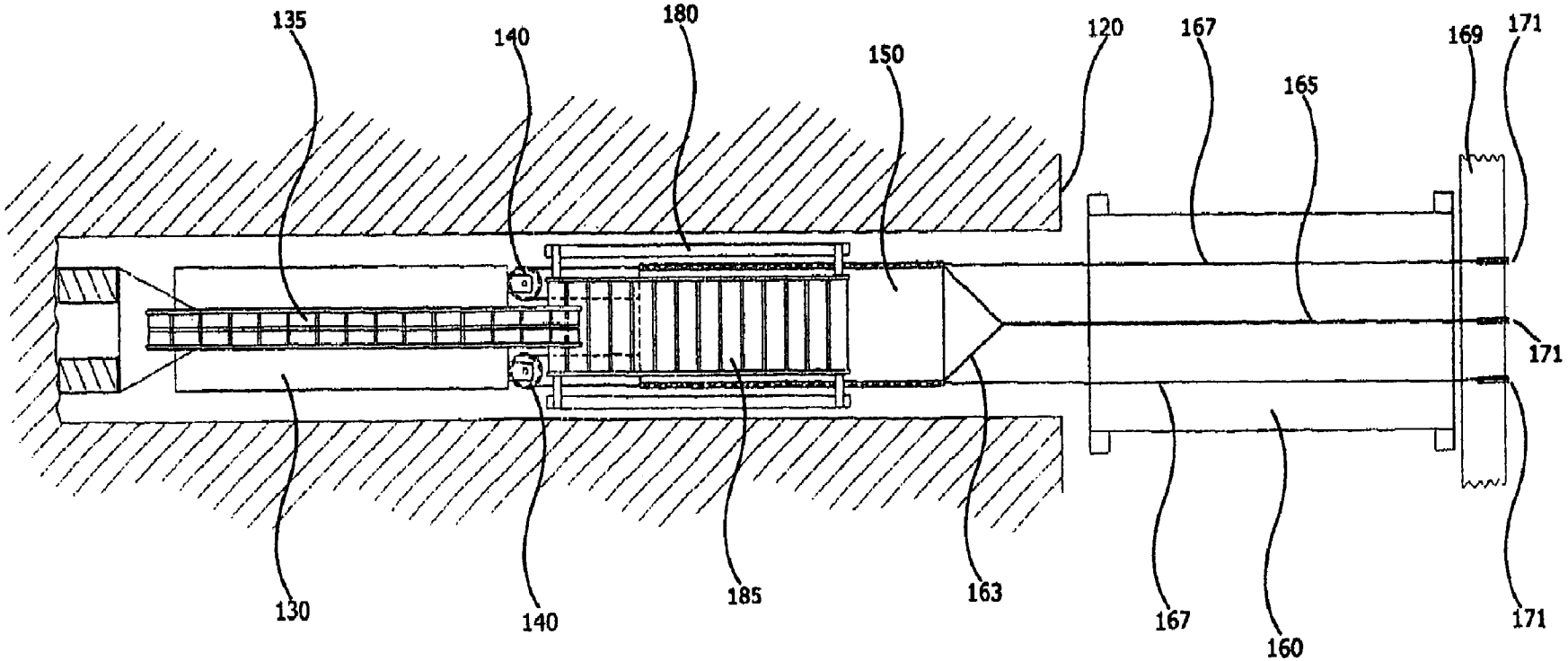
FIG. 4 is a plan view showing an alternate embodiment of the present invention.
Figure 4A:
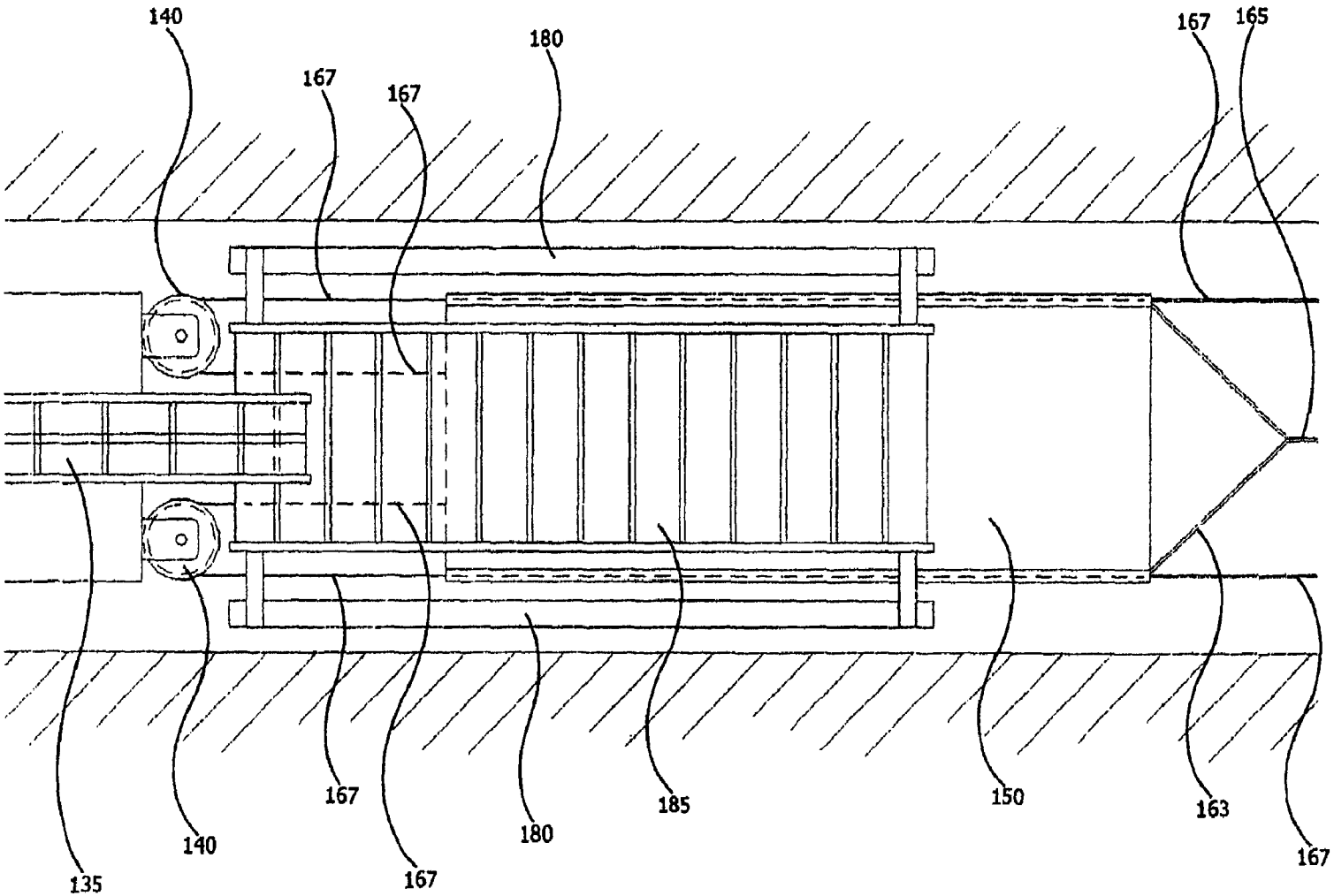
FIG. 4*a* is an exploded view of FIG. 4.

FIGS. 4 and 4*a* show yet another embodiment of a winched sled 150 being used to transfer mined material from inside a mine to outside the mine. In this embodiment, a surge feeder conveyor 180 is positioned behind the miner 130 to receive mined material slowly from the miner discharge conveyor 135 while the sled 150 is winched out with its load. Once the sled 150 returns from unloading and is winched under the surge feeder conveyor 185, the surge feeder conveyor 185 quickly feeds mined material onto the sled 150 as the sled 150 is pulled out from under the surge feeder conveyor 185. Once the sled 150 is full, the surge feeder conveyor 185 slows down to receive mined material from the miner discharge conveyor 135 and the sled 150 is high speed winched to the outside platform 160. A unique ejector system cleans the mined material from the sled 150 at outside platform 160.

Figure 5:
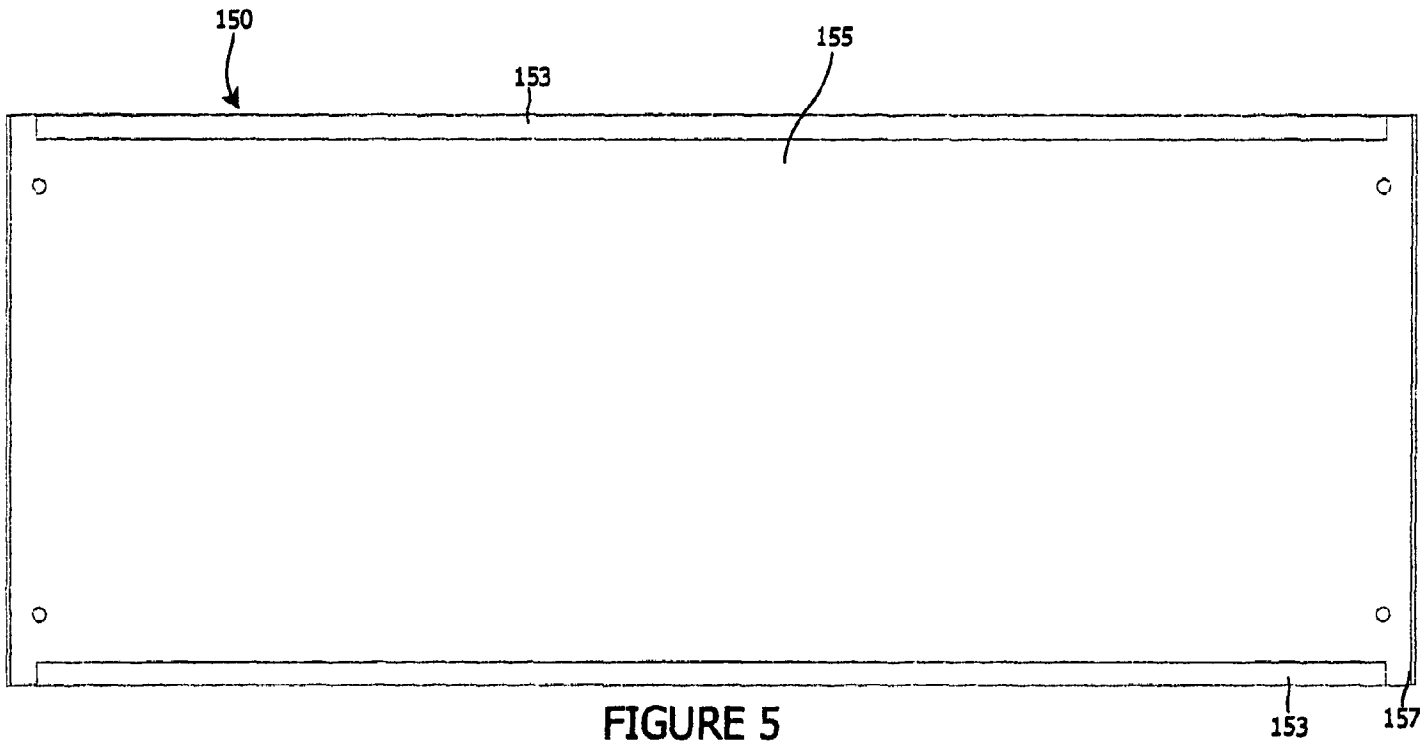
FIG. 5 is a plan view of a sled as may be used in the present invention.
Figure 5A:
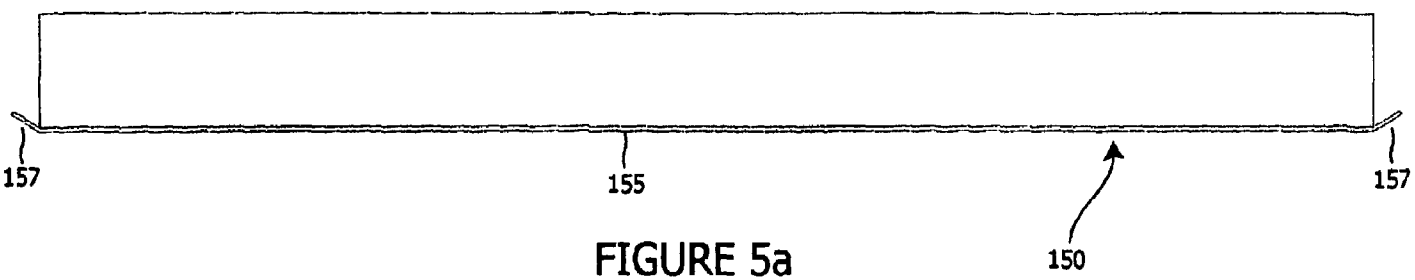
FIG. 5*a* is side view of the sled shown in FIG. 5.
Figure 5B:
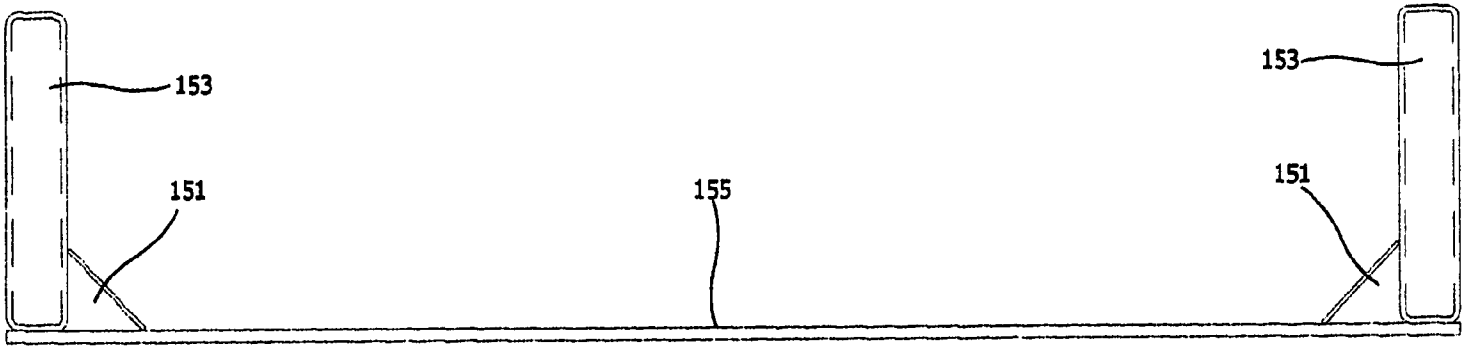
FIG. 5*b* is a center cut view of the sled shown in FIG. 5.
Figure 5C:
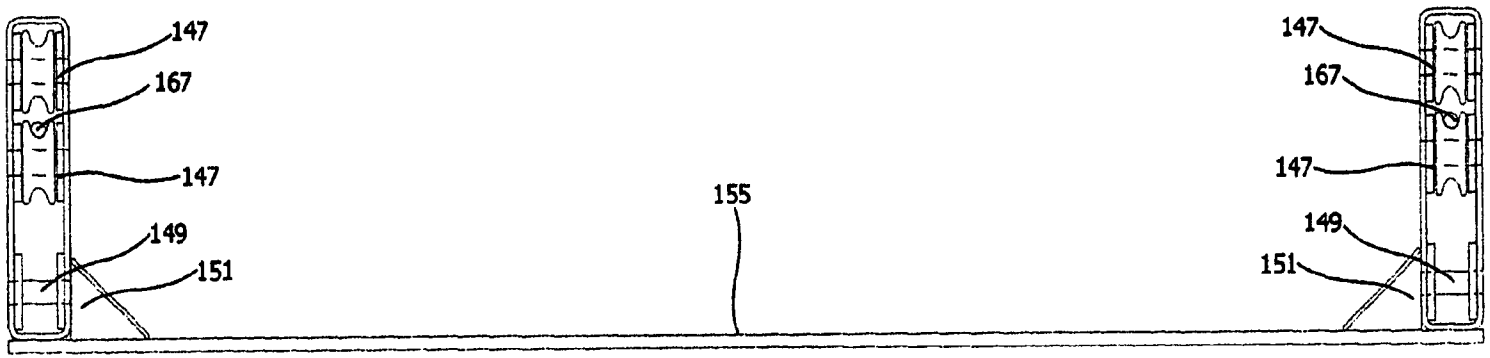
FIG. 5*c* is end view of the sled shown in FIG. 5.
Figure 5D:
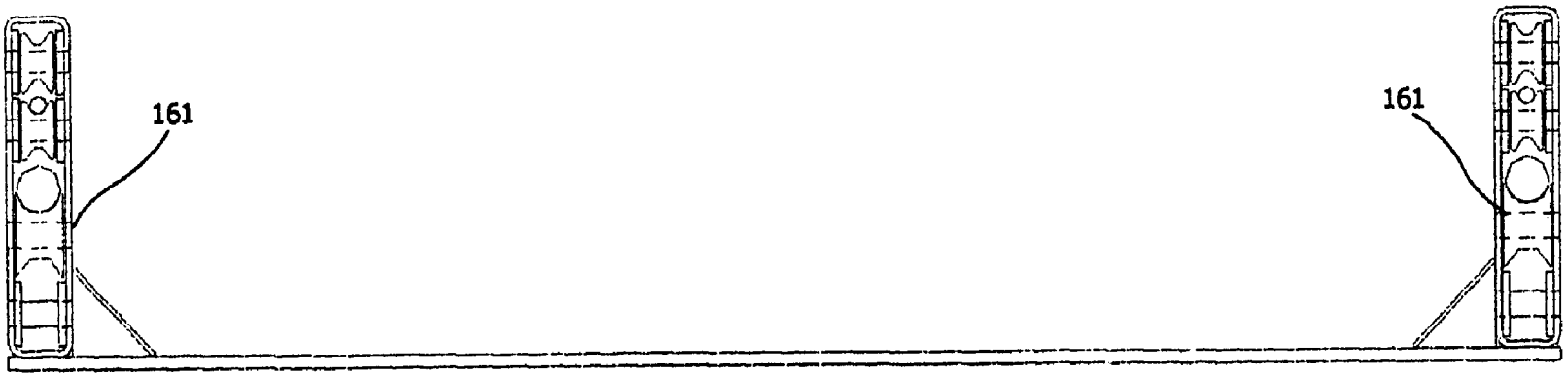
FIG. 5*d* is end view of the sled shown in FIG. 5.
Figure 5E:
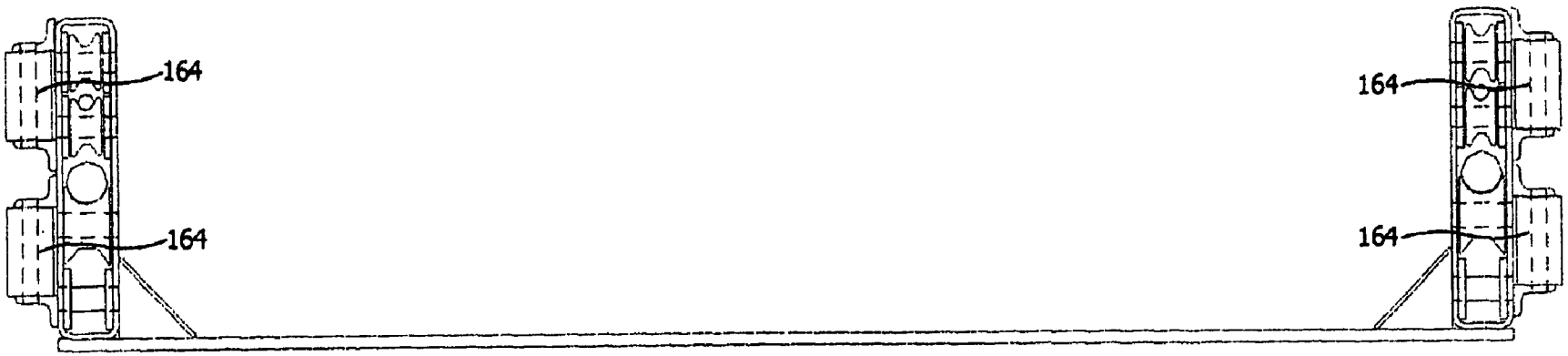
FIG. 5*e* is end view of the sled shown in FIG. 5.
Figure 5F:
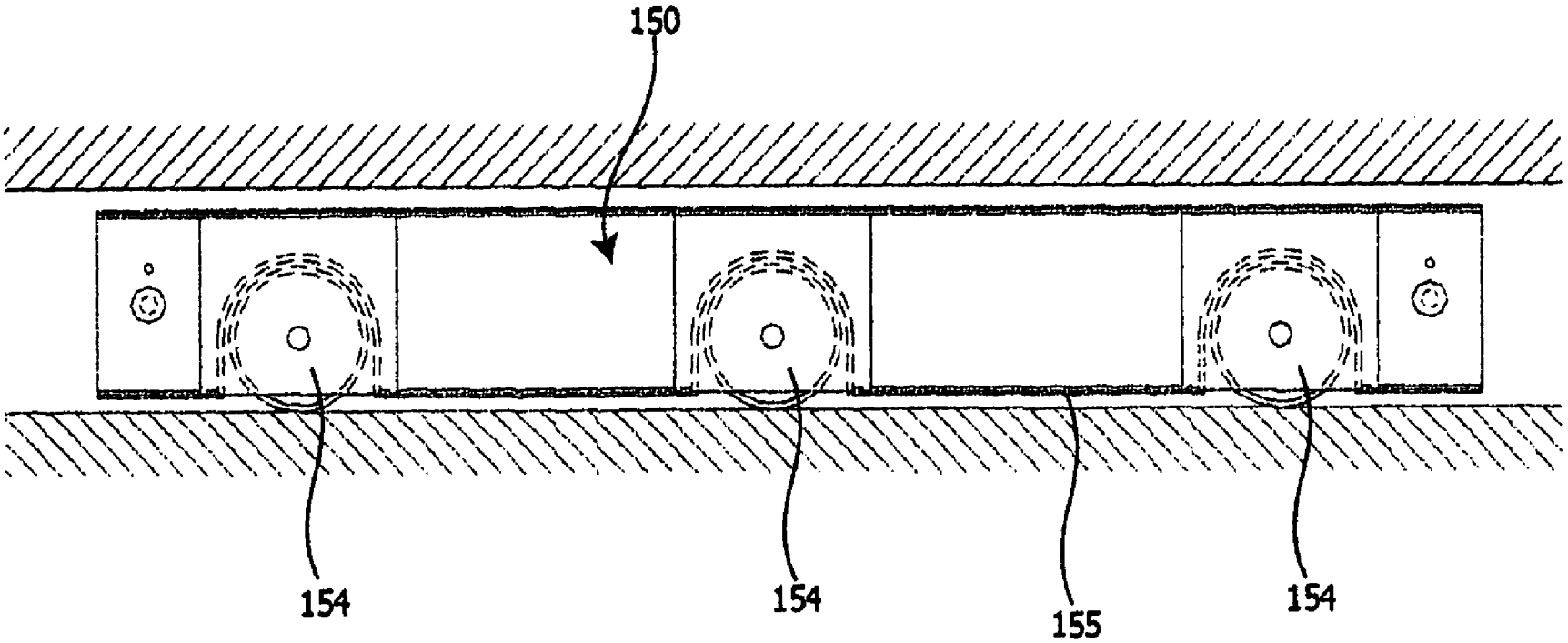
FIG. 5*f* is a side view of the sled shown in FIG. 5.

FIGS. 5-5*f* show different views of a sled 150 which can be used with the present invention. Although a sled is shown, other types of transport devices, such as cars, beams or buggies, whether shielded or not, whether flat-bottomed, wheeled or on rails, can be used with the present invention. FIG. 5 shows a plan view of the sled 150 as used in the preferred embodiment of the present invention. The sled floor plate 155 has an attached sled nose 157 to keep it from digging into mine floor. The sled has side frames 153 to keep mined material being transferred from spilling to outside.

FIG. 5*b* shows an end view cut midway along the length of the sled 150 showing the side frames 153 and the gusset stiffened plates 151 attached to help support the side frames 153, both of which are welded to the floor plate 155.

FIG. 5*c* shows an end view of the sled 150. The end of the sled 150 includes guide rollers or fairleads 147 for guiding the haul back rope 167 through the side frame 153. A pull pin 149 is shown on the pull out end which attaches to a pull out sling 163.

FIG. 5*d* shows an alternate end view of the sled 150 that includes rollers 161 that may be used to guide the miner, water and control cables through the side frame 153.

FIG. 5*e* shows another alternate end view of the sled 150. Side rollers 164 may be used to keep the sled 150 off of mine rib walls while the sled 150 is being pulled out of and into the mine. The side rollers 164 may also be used to keep the sled 150 properly guided through highwall shields 145, in the event shields 145 (see FIG. 8) are used to protect the miner 130 or sled 150 from falling rock or cave-ins.

FIG. 5*f* shows a side view of the sled 150 with wheels 154 which can be used when floor conditions allow. If the floor conditions are so poor that the sled bottom 155 is dragging, a sled 150 without wheels can be used.

Figure 6:
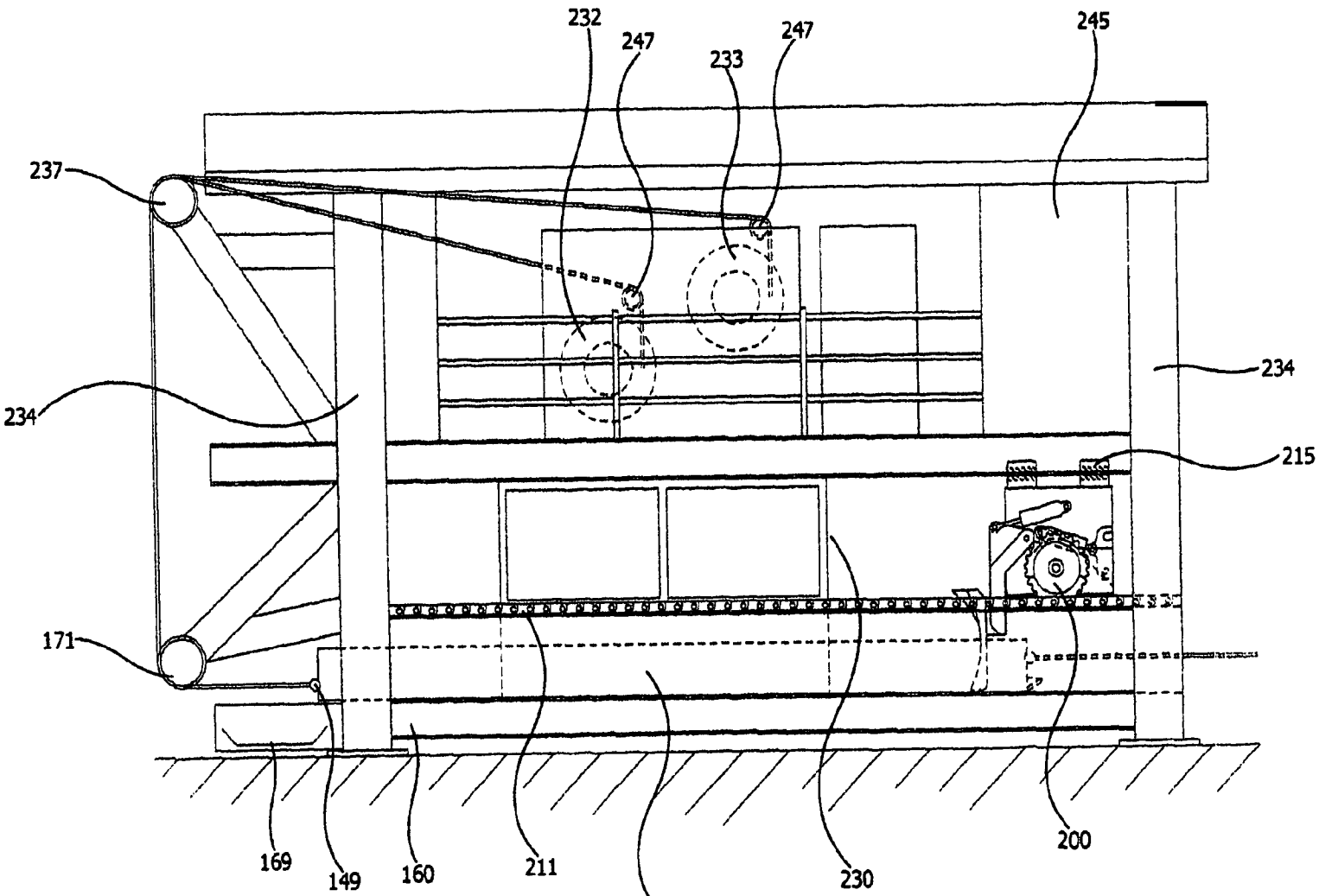
FIG. 6 is side view of a platform as may be used in the present invention.

FIG. 6 shows an outside platform 160 onto which the sled 150 is pulled outside of the mined hole 115 to have mined material removed. The pull out winch 232 pulls rope 165 through the upper guide sheave 237 and the lower guide sheave 171. The rope 165 is attached to a pull pin 149 on the sled 150 such that when the winch 232 pulls the rope 165, the sled 150 is pulled out of the mined hole 115 onto the platform 160. The haul back winch 233 is used to pull the sled 150 back into the hole 115 to the continuous miner 130 for another load. The haul back winch 233 pulls its rope 167 through another set of sheaves off-set from the pull out winch 232 sheaves 171 & 237 to get the rope from the pull out winch 232 to the sled side frames 153. The pull out winch 232 and the haul back winch 233 can be configured as one to pull the sled 150 into and out of the mine, in a manner similar to a clothes line. In this embodiment, a slip clutch releases additional rope as needed. Fleet angle compensators 247 can be used to keep the winch rope 165 & 167 wound properly if needed.

To empty the mined material from the sled 150, the driver/puller/scraper 200 is lowered into the sled 150 and driven over the driver-puller-scrapper chain 211 while being held down by the hold down rollers 215. As the driver/puller 200 is driven, the ejection blade 203 ejects the mined material onto the side-discharge cross-feed-conveyor 169 to be conveyed to either side for stockpiling. The corner post 234 can have hydraulic leveling devices to raise and lower the platform 160, if desired. Also shown is an electrical/mechanical control room 245 which includes electrical and mechanical controls for the system and may included hydraulic pumps and controls if needed.

Figure 6A:
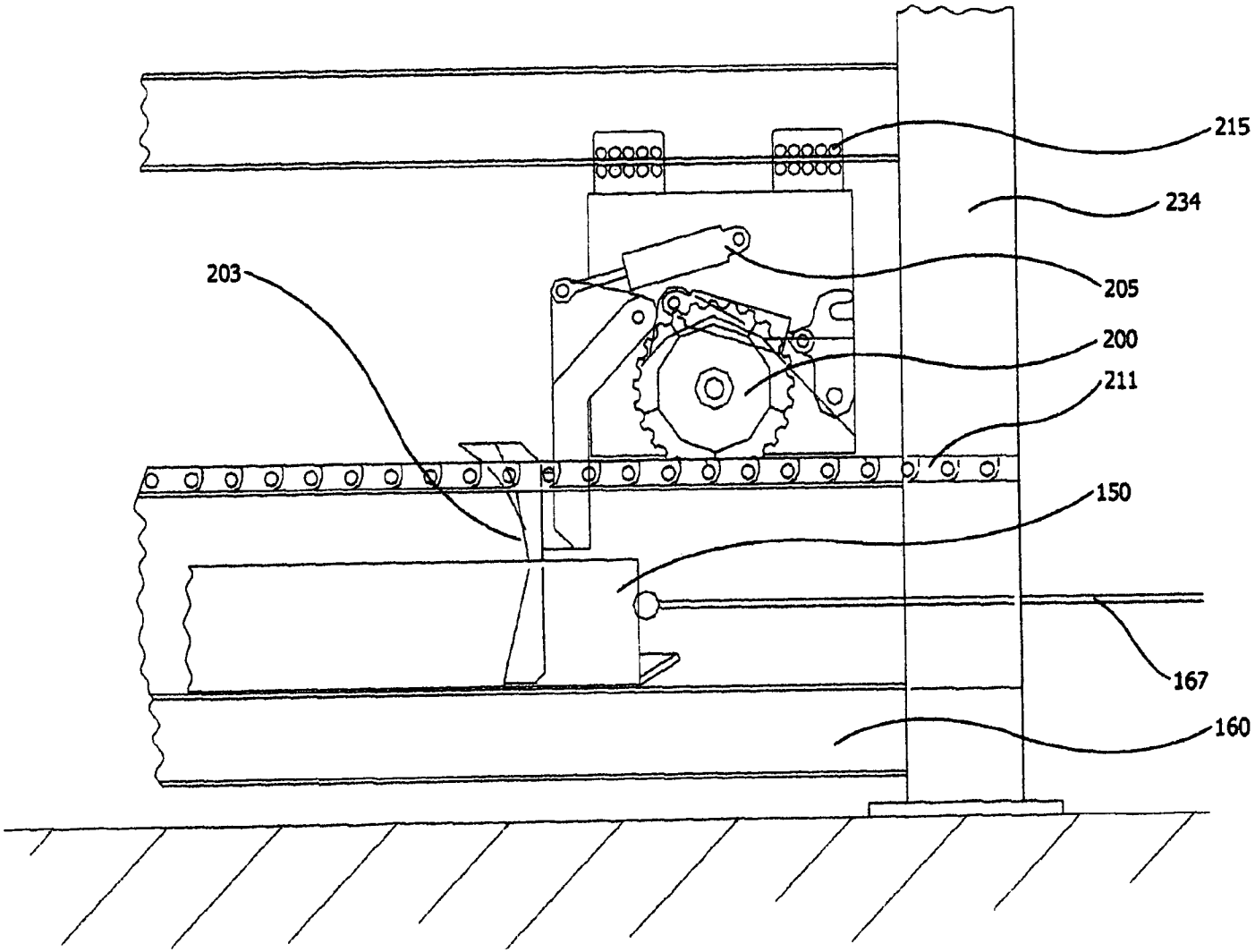
FIG. 6*a* is an exploded view of FIG. 6.

FIG. 6*a* is an exploded view of FIG. 6 showing the haul back rope 167 attached to the rear of the sled 150. The ejection blade lift cylinder 205 lifts the ejection blade 203 so the sled 150 can pass underneath.

Figure 6B:
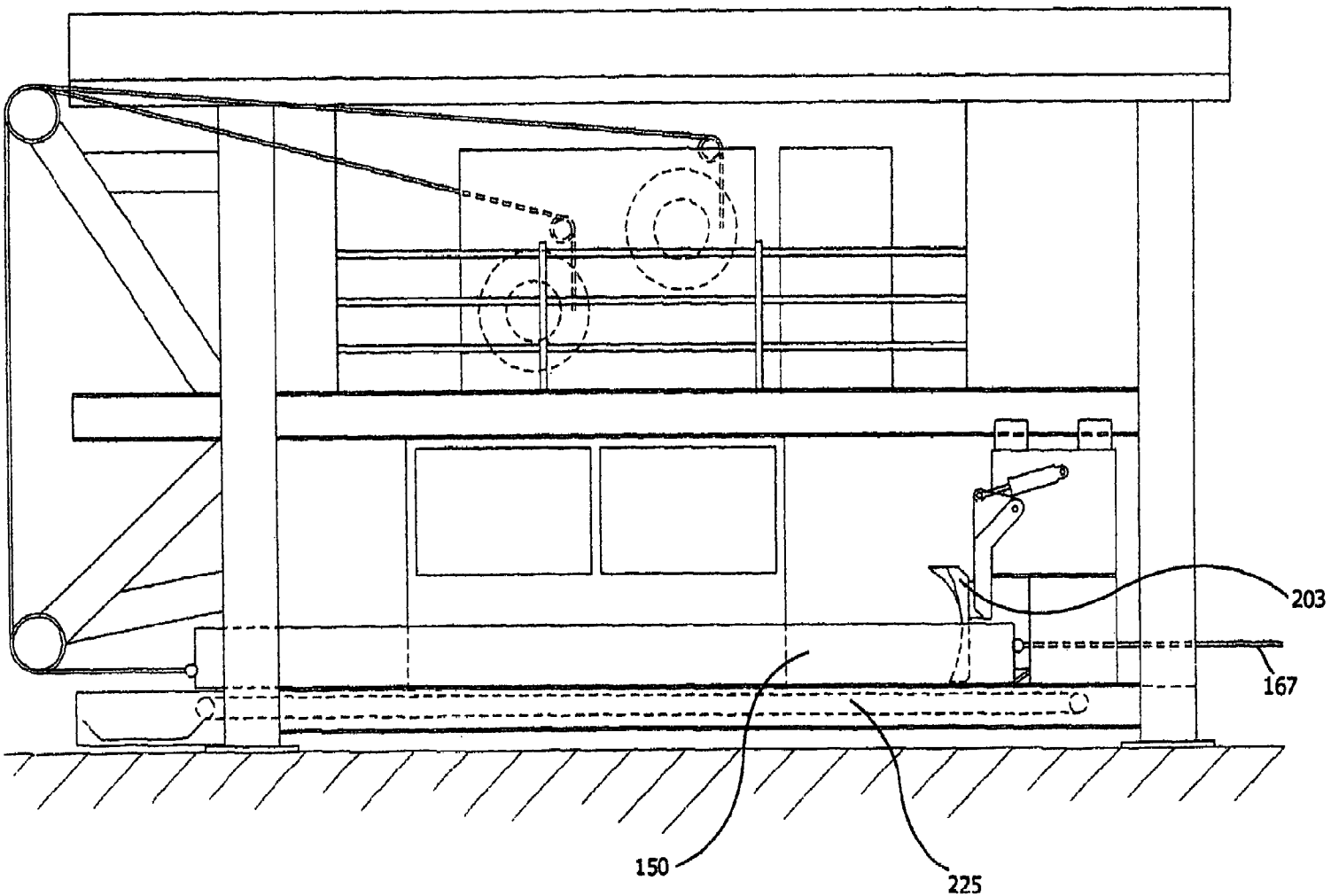
FIG. 6*b* is a side view of another platform as may be used in the present invention.
Figure 6C:
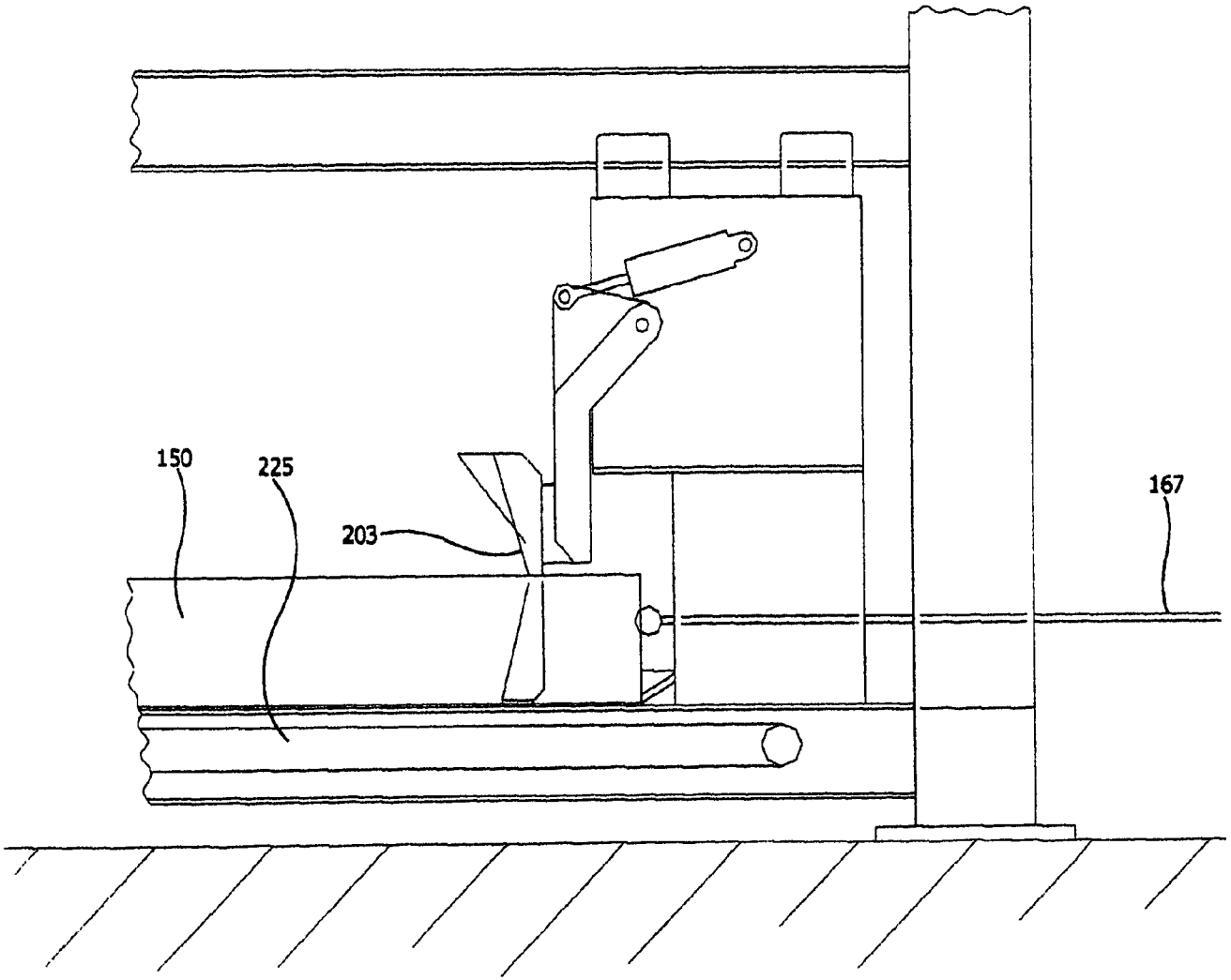
FIG. 6*c* is an exploded view of FIG. 6*b;*

FIGS. 6*b* and 6*c* show an alternate embodiment of a platform having a belly conveyor 225 within its structure. An ejection blade 203 is lowered into the sled 150 and, as the haul back rope 167 is pulling the sled 150 back into the mined hole 115, the mined material is ejected off the sled 150 onto the belly conveyor 225 which carries the mined material back to the side-discharge cross feed conveyor 169.

Figure 6D:
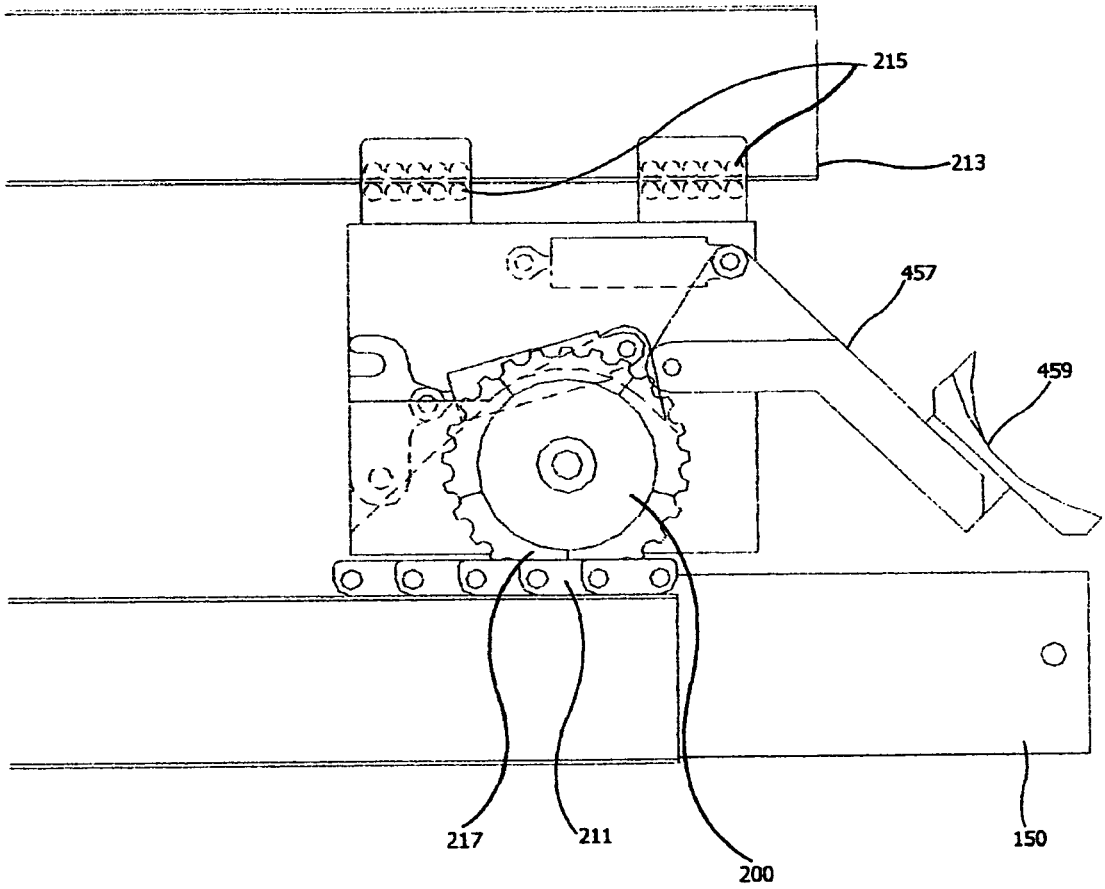
FIG. 6*d* is an exploded view of FIG. 6*b;*

FIG. 6*d* shows a side view of a driver-puller-scrapper 200 with an ejector arm 457 and a driven ejector blade 459 in the up position so the sled 150 can pull underneath. Also shown are hold down rollers 215 attached around a hold down beam 213 to keep the driver-puller-scraper sprocket 217 in the chain driver-puller-scraper chain 211.

Figure 7A:
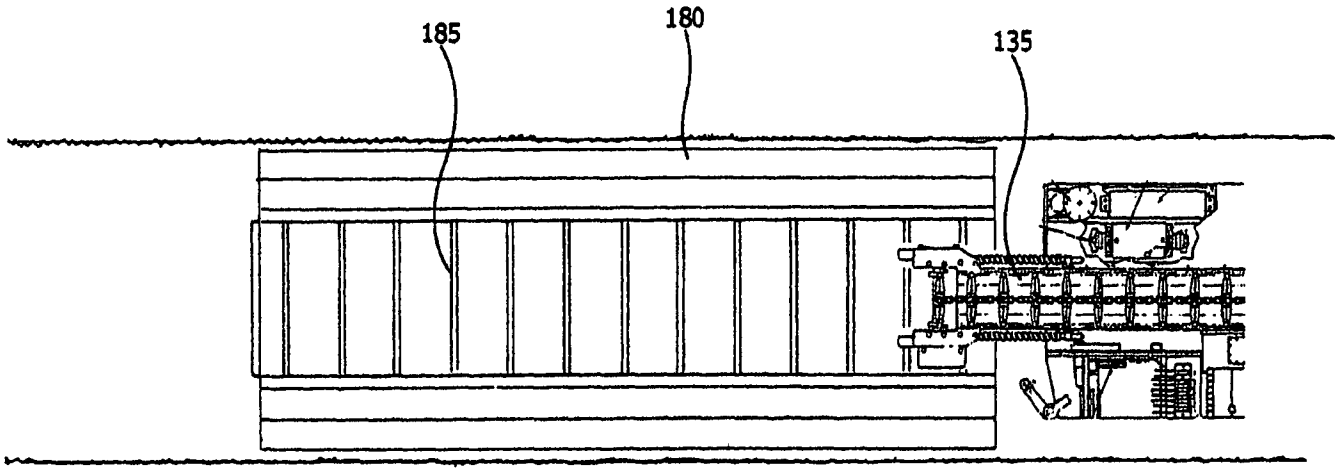
FIG. 7*a* is plan cut view of FIG. 7.
Figure 7:
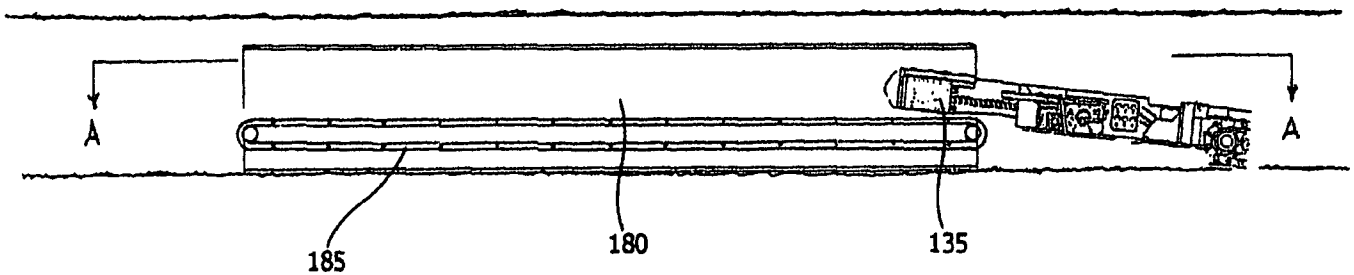
FIG. 7 is a cut side view showing a miner discharge conveyor as may be used in conjunction with the present invention.
Figure 7B:
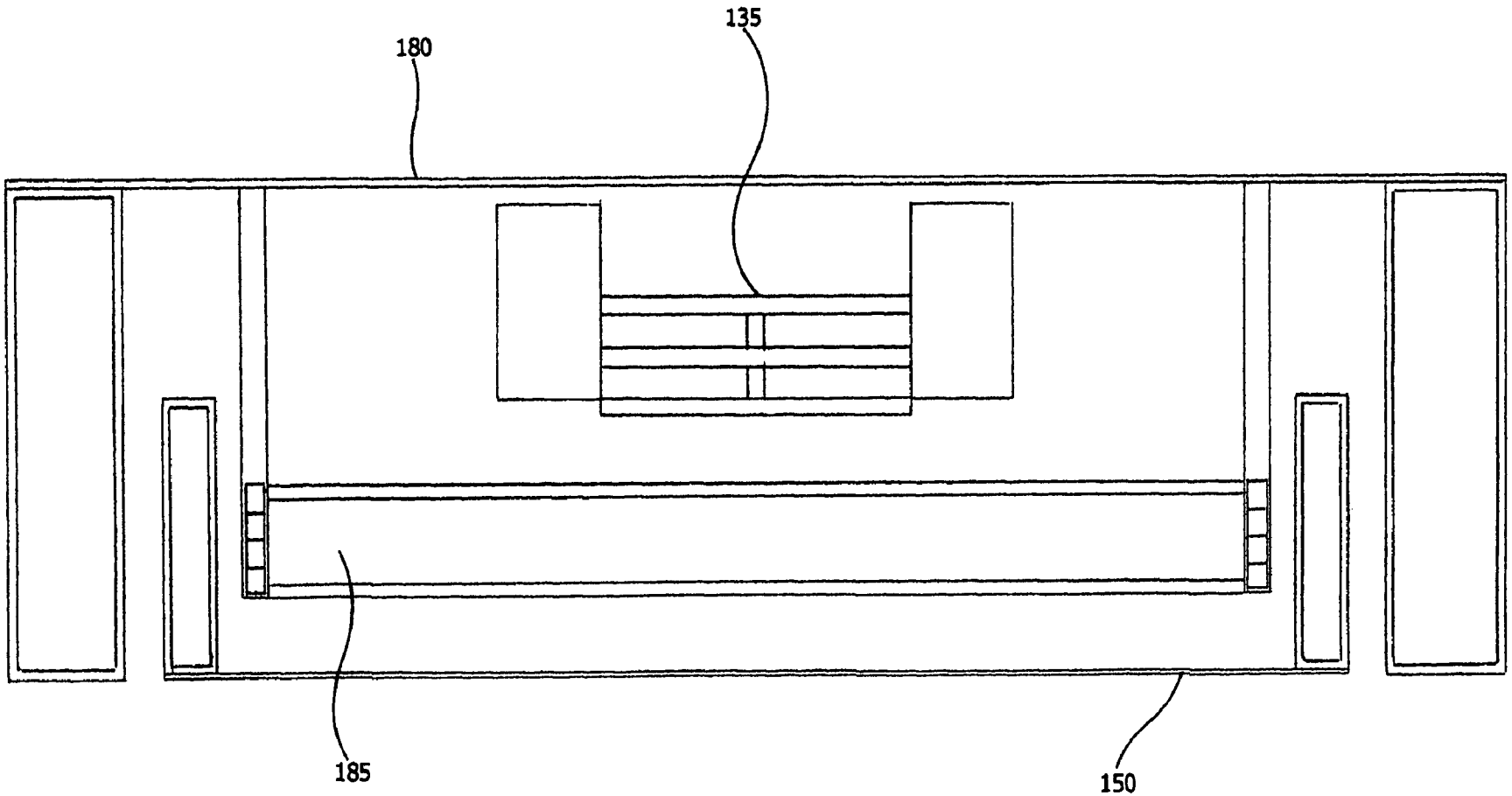
FIG. 7*b* is an end view of FIG. 7.

FIGS. 7, 7*a* and 7*b* show a continuous miner discharge conveyor 135 positioned to discharge mined material onto a surge feeder conveyor 185 which can be either a chain or a belt. The surge feeder 180 is a holding device to accept material from the miner discharge conveyor 135 slowly as the sled 150 is winched out, discharged and returned beneath the surge feeder conveyor 185 or to the tail end of the surge feeder conveyor 185. Once the sled 150 has returned, the surge feeder conveyor 185 is sped up, thus feeding mined material onto the sled 150 quickly. Once the sled 150 is filled, the surge feeder conveyor 185 is slowed down again to build another load. FIG. 7*a* shows cut plan view under the top showing the same. FIG. 7*b* shows an end view of same with the sled 150 pulled up beneath the surge feeder conveyor 185. The surge feeder conveyor 185 can be used within shields 145, as shown in FIG. 8, to load a sled 150 pulled in and out of a mined hole 115 through shields 145 by winches as well.

Figure 8:
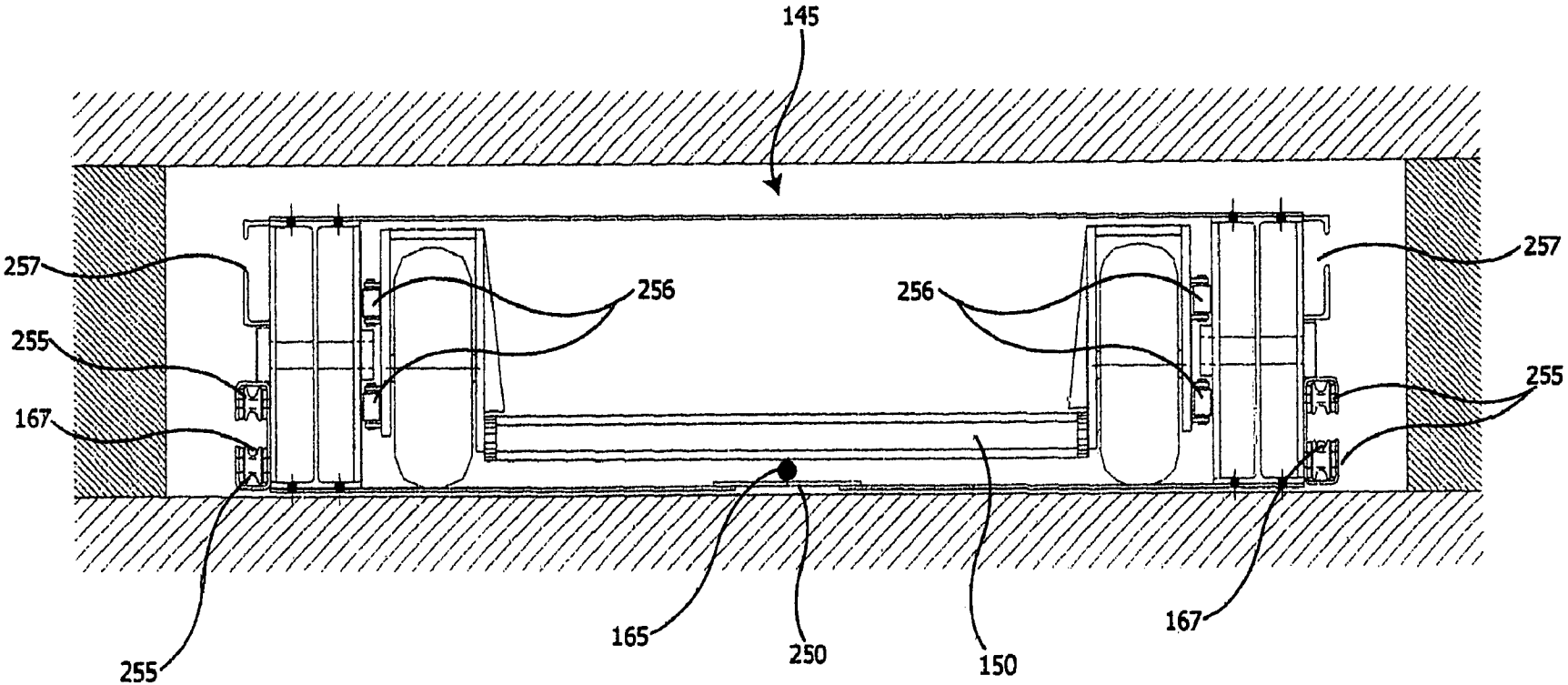
FIG. 8 is an end view of an alternate embodiment of the present invention.

FIG. 8 shows an alternate embodiment for winching sleds 150 into and out of mines, whereby a non-motorized sled 150 is being winched into and out of a mine through shields 145 such as those described in copending U.S. patent application Ser. No. 10/862,254, entitled "Shield System For Coal Mining," now U.S. Pat. No. 7,207,632, incorporated herein by reference in its entirety. In poor roof conditions, the shield 145 provides additional protection against falling rocks or roof cave-ins. The pull out rope 165 is slid through floor opening flaps 250 in the floor of the shield 145 so the shield 145 can be inserted onto a platform 160 while the sled 150 is inside the shields 145 either exiting the mine with a load or returning into the mine to be loaded with mined material. The shields 145 can also be connected to one another while the sled 150 is making its trip. The haul back rope 167 travels through rope guides 255 on the outside of the shield 145. The view shown is a cut view which does not show the pull out rope 165 attached to the sling 163 and to the ends of the sled 150. Guide rollers 256 are preferably attached to the sides of the sled 150 to guide it though the shields 245. Cable treys 257 are preferably provided on either side of the shield 145 forte continuous miner, water and control cables if needed.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A highwall mining system for transporting mined material from a face of ore in a mined hole across an unimproved mine floor to an outside area comprising a remotely controlled continuous highwall miner including a front end and a rear end, said front end of said continuous miner oriented toward said face of ore;

a platform in said outside area;

a sled adapted to skid on said unimproved mine floor and transport said mined material from said continuous miner to said platform, said sled including a substantially flat floor plate having two ends and two sides, two side frames extending upward from said sides of said floor plate, and an open top;

two guide rollers aligned one above another on said side frames;

a pull pin on each of said side frames at said rear end of said sled;

a sling secured to said pull pins;

a pull out winch secured to said platform, said pull out winch adapted to pull said sled from said rear end of said continuous miner to said platform;

a haul back winch secured to said platform, said haul back winch adapted to pull said sled from said platform to said rear end of said continuous miner;

said haul back winch including two return sheaves on said rear end of said continuous miner and a third sheave on said front end of said sled;

a pull out rope extending from said pull out winch to said sling at said rear end of said sled; and a haul back rope extending from said haul back winch to said platform.

2. The highwall mining system of claim 1 wherein said haul back rope extends from said haul back winch through said guide rollers on a first of said side frames of said sled, through one of said return sheaves, through said third sheave, through a second of said return sheaves, through said guide rollers in a second of said side frames of said sled, and thence to aid dc-off on said platform.

3. The highwall mining system of claim 1 wherein said sled includes an open front end facing said rear end of said continuous miner; and an open rear end facing said platform.

4. The highwall mining system of claim 1 wherein said sled includes a gusset stiffener plate on each side of said sled extending between said floor plate and each of said side frames.

5. The highwall mining system of claim 1 including a sled nose at each end of said floor plate, said sled nose at an upturned angle with respect to said floor plate to prevent said floor plate from digging into said unimproved mine floor.

6. The highwall miffing system of claim 1 wherein said side frames of said sled include an outer surface and one or mare side rollers on said outer surface, said side rollers adapted to repel said sled from any side obstructions during transport of said sled.

7. The highwall mining system of claim 1 including a side-discharge cross-feed-conveyor at said platform for accepting said mined material discharged from said sled, said side-discharge cross-feed-conveyor conveying said mined material sideward of said platform for stockpiling of said mined material.

8. The highwall mining system of claim 1 including a miner discharge conveyor at the rear end of said continuous miner; and a surge feed conveyor between said miner discharge conveyor and said sled, said surge feed conveyor adapted to slowly accept and hold said mined material from said miner discharge conveyor as said sled is winched out of said mined hole, said surge feed conveyor adapted to rapidly discharge said mined material onto said sled when said sled is pulled up beneath said surge feed conveyor.

* * * * *

UNITED STATES PATENT AND TRADEMARK OFFICE

CERTIFICATE OF CORRECTION

PATENT NO. : 7,594,702 B2
APPLICATION NO. : 10/867139
DATED : September 29, 2009
INVENTOR(S) : Sterling W. Lowery It is certified that error appears in the above-identified patent and that said Letters Patent is hereby corrected as shown below:

Column 8, line 63, change “miffing” to --mining--;
Column 8, line 64, change “mare” to --more--.

Signed and Sealed this

First Day of December, 2009

David J. Kappos

David J. Kappos
*Director of the United States Patent and Trademark Office*